US009360285B1

(12) United States Patent
Motes, III et al.

(10) Patent No.: US 9,360,285 B1
(45) Date of Patent: Jun. 7, 2016

(54) PROJECTILE CARTRIDGE FOR A HYBRID CAPILLARY VARIABLE VELOCITY ELECTRIC GUN

(71) Applicant: Texas Research International, Inc., Austin, TX (US)

(72) Inventors: Doyle Tunnie Motes, III, Austin, TX (US); Alexander Edward Zielinski, Cedar Park, TX (US)

(73) Assignee: Texas Research International, Inc., Austin, TX (US)

( * ) Notice: Subject to any disclaimer, the term of this patent is extended or adjusted under 35 U.S.C. 154(b) by 204 days.

(21) Appl. No.: 14/320,946

(22) Filed: Jul. 1, 2014

(51) Int. Cl.
*F41F 1/00* (2006.01)
*F42B 6/00* (2006.01)
*F42B 14/06* (2006.01)

(52) U.S. Cl.
CPC ..... *F42B 6/006* (2013.01); *F42B 14/06* (2013.01)

(58) Field of Classification Search
CPC ..... F42B 6/006; F42B 14/06; F42B 5/08; F41B 6/00
USPC ..... 89/8; 102/202.4, 440
See application file for complete search history.

(56) References Cited

U.S. PATENT DOCUMENTS 4,352,397 A * 10/1982 Christopher ..... C06B 33/02 149/44
4,711,154 A * 12/1987 Chryssomallis ..... F41B 6/00 102/440
4,895,062 A * 1/1990 Chryssomallis ..... F41B 6/00 102/440
5,012,719 A * 5/1991 Goldstein ..... B01J 19/087 102/531
5,016,518 A * 5/1991 Kaplan ..... F41A 1/02 102/202.5
5,072,647 A * 12/1991 Goldstein ..... F42C 19/0811 102/202.8
5,171,932 A * 12/1992 McElroy ..... F41B 6/00 102/700
5,183,956 A * 2/1993 Rosenberg ..... F41B 6/00 102/374
5,231,242 A * 7/1993 Chryssomallis ..... F41B 6/00 102/472

(Continued)

*Primary Examiner* — Michelle R Clement
(74) *Attorney, Agent, or Firm* — Michael A. Ervin; M. A. Ervin & Associates

(57) ABSTRACT

A projectile cartridge for a hybrid capillary variable velocity electric launcher comprising a launcher and breech/barrel assembly as well as a projectile and a pulsed power supply for supplying adjustable amounts of electric energy to permit variable projectile velocity. The projectile cartridge also includes at least an anode and cathode section, a fuse wire, a capillary liner, and the projectile, which may include both a slug and a sabot jacket. A hybridization medium is included with restraining mechanisms.

20 Claims, 9 Drawing Sheets

(56) References Cited

U.S. PATENT DOCUMENTS 5,233,903 A * 8/1993 Saphier ..... F41B 6/00 89/7
5,235,894 A * 8/1993 Nitschke ..... F41B 6/00 124/3
5,355,764 A * 10/1994 Marinos ..... F42C 19/0811 102/472
5,429,030 A * 7/1995 Tidman ..... F41A 1/00 102/202.7
5,444,208 A * 8/1995 Mortensen ..... F42B 5/08 102/202.8
5,546,844 A * 8/1996 Krumm ..... F41B 6/00 89/16
5,549,046 A * 8/1996 Widner ..... F42B 6/006 102/202.7
5,612,506 A * 3/1997 Goldstein ..... F41B 6/00 102/202.8
5,886,290 A * 3/1999 Lindblom ..... F41B 6/00 102/530
5,909,001 A * 6/1999 Goldstein ..... F41B 6/00 60/204
5,945,623 A * 8/1999 Goldstein ..... F41B 6/00 102/202.8
5,988,070 A * 11/1999 Krumm ..... F42B 6/006 102/430
6,119,599 A * 9/2000 Johnson ..... F42B 5/08 102/202
6,186,040 B1 * 2/2001 Weise ..... F41B 6/00 102/472
6,539,874 B2 * 4/2003 Weise ..... F42C 19/0834 102/202
6,703,580 B2 * 3/2004 Brunet ..... C06B 27/00 102/202.7
6,759,798 B2 * 7/2004 Kim ..... F42B 3/00 102/202.5
7,905,178 B2 * 3/2011 Dryer ..... F41A 1/02 102/202
8,746,120 B1 * 6/2014 Nolting ..... F41A 19/58 102/202
2002/0157559 A1 * 10/2002 Brunet ..... C06B 27/00 102/472
2006/0144214 A1 * 7/2006 Goldstein ..... F41A 1/04 89/8
2011/0061555 A1 * 3/2011 Gustavsson ..... F42B 5/08 102/440

* cited by examiner

PROJECTILE CARTRIDGE FOR A HYBRID CAPILLARY VARIABLE VELOCITY ELECTRIC GUN

STATEMENT OF RIGHTS TO INVENTION MADE UNDER FEDERALLY SPONSORED RESEARCH

This invention was made with government support under the Small Business Innovative Research (SBIR) Program, Topic Number A11-059 contract number W9113M-12-C-0027 awarded by the U.S. Army USASMDA/ARSTRAT. The government has certain rights in the invention.

BACKGROUND

Counter Rocket, Artillery, and Mortar, abbreviated C-RAM or Counter-RAM, is a system used to detect and/or destroy incoming artillery, rockets and mortar rounds in the air before they hit their ground targets, or simply provide early warning.

Existing C-RAM systems have a stated velocity ceiling that is set by the propellant powder load. The U.S. Army is looking forward into the future to a potential replacement for the C-RAM system that will permit a variable muzzle velocity, while maintaining the present velocity ceiling of existing C-RAM. Hybrid electric launchers are one technology that has been proposed as an enhancement or a replacement for conventional propellant powder driven guns. Electrothermal (ET) and Electrothermal-chemical (ETC) launchers use a high current arc to create sufficient temperatures and pressures necessary to accelerate a projectile. The use of a hybrid electric launcher means that velocity variability can be achieved by the next generation C-RAM (by providing a projectile cartridge with a certain designed velocity floor and the ability to "dial-in" additional velocity by increasing the electrical energy imparted into the launcher during firing) to control collateral damage in future urban/suburban conflict environments. Additionally, the use of such a projectile cartridge in a hybrid electric launcher has the potential to remove significant amounts of the mass/volume of hazardous propellant that must be transported, easing the demands on the supply chain.

There is a need for C-RAM systems that easily permit variable muzzle velocities. The proposal described herein does this using a unique projectile cartridge using hybridization technology.

BRIEF SUMMARY

This need can be met by the use of hybrid capillary electric launchers to replace conventional propellant powder driven guns. Hybrid capillary electric launchers that can do this comprise the launcher itself (breech/barrel assembly), as well as the optimum projectile cartridge and a pulsed power supply for supplying adjustable amounts of electric energy to permit variable velocity. The projectile cartridge described herein includes least an anode and cathode section, one or more fuse wires, a capillary liner, a hybridization medium, and a projectile, which may include both a slug and a sabot jacket.

In one embodiment the hybridization is achieved by the use of methanol, ethanol, or water as a hybridizing medium.

In another embodiment the hybridization medium is restrained within the capillary by use of sponges.

In another embodiment the sponges used for restraining the hybridization medium are cylindrical sponges deployed around the fuse wire.

In another embodiment the hybridization medium is restrained within the capillary by encapsulation.

In another embodiment the hybridization medium is further restrained by use of a burst diaphragm placed over the cathode.

In another embodiment the burst diaphragm may comprise a Mylar diaphragm.

In another embodiment the projectile slug may comprise a 6061-T6 aluminum alloy.

In another embodiment the projectile slug may comprise Macor ceramic.

In another embodiment the sabot jacket may comprise Nylon 6/6.

In another embodiment the fuse wire is may comprise Al, Cu, Co, or Ni.

In another embodiment the capillary material may comprise polycarbonate or high-density polyethylene.

In another embodiment the pulsed power supply is produced by an over-damped LRC circuit.

DESCRIPTION OF DRAWINGS

There are disclosed in the drawings and detailed description to follow various embodiments of the solution proposed herein. It should be understood, however, that the specific embodiments given in the drawings and entailed description do not limit the disclosure. On the contrary, they provide the foundation for discerning the alternative forms, equivalents, and modifications that will be encompassed in the scope of the eventual claims.

DETAILED DESCRIPTION

Described below will be a proposed projectile cartridge for a hybrid variable velocity electric gun or launcher system. The use of a hybrid variable electric launcher means that velocity variability can be achieved by increasing the electrical energy imparted into a launcher during firing. There are numerous potential advantages to the use of a hybrid electric launcher. These include the ability to reduce collateral damage from use of such a weapon. Additionally, the use of a hybrid variable velocity electric launcher has the potential to remove significant amounts of the mass/volume of the hazardous propellant that must be transported, easing the demands on the supply chain.

A typical hybrid capillary variable velocity electric gun system includes the launcher itself (breech/barrel assembly), as well as the projectile cartridge and a pulsed power supply for supplying the variable velocity. All of these will be described.

Projectiles

Figure 1:
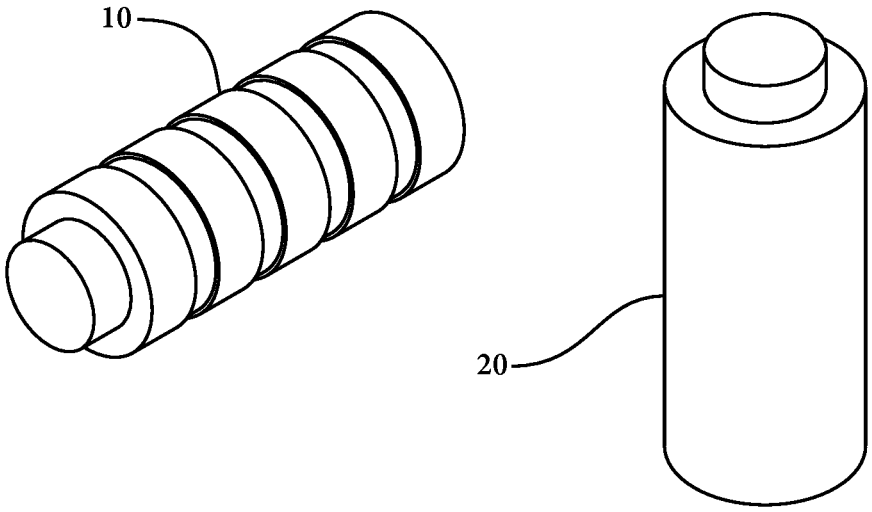
FIG. 1 is an illustration of a projectile for the hybrid capillary electric launcher.

Two different scales of projectiles were used in the experimental work leading to the projectile cartridge development and proven effective in this application. They will be referred to as sub-scale and full-scale. FIG. 1 illustrates an embodiment of a sub-scale projectile, which for testing purposes was nominally 0.988" in length. This includes the slug and jacket assembled. The slug can be a metal or a ceramic; the jacket may be an engineered plastic. The left figure 10 illustrates a solid model and the right figure 20 the final assembly. In one embodiment, this projectile was an aluminum alloy (6061-T6 AL) slug surrounded by a Nylon 6/6 jacket. The jacket acts as electrical insulator to protect the slug from arc damage from the current pulse supplied to the launcher. The projectile with the aluminum alloy slug was electrically conductive. In another embodiment a slug of Macor ceramic (an electrically non-conductive material). Macor is a machinable glass-ceramic sold by Corning, Inc.

Two different full-scale electrically conductive projectiles were tested—Nylon 6/6 jackets with a 6061-T6 Al slug (for the half-mass projectiles—7.0 g) and Nylon 6/6 jackets with an AISI 1018 steel slug (for the full-mass projectiles—14.0 g). Electrically non-conductive slugs included Macor (for the half-mass projectiles) and zirconia (for the full-mass projectiles).

Figure 2:
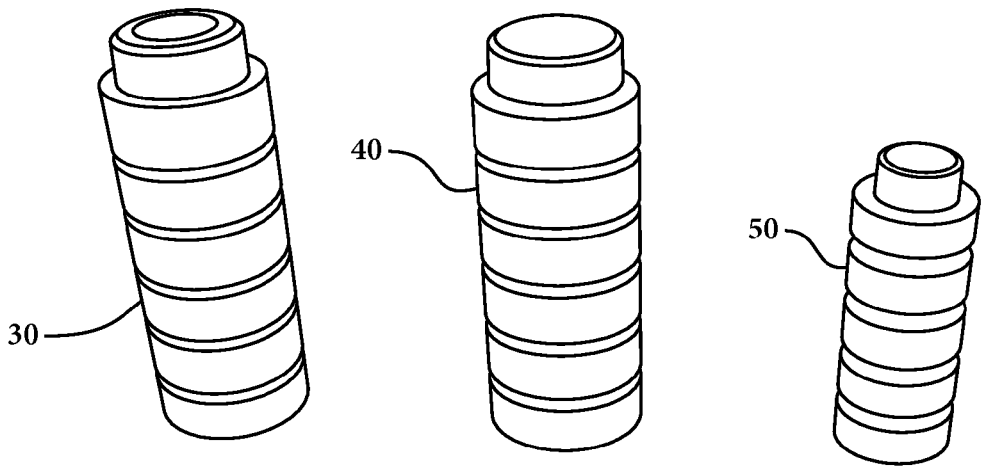
FIG. 2 is an illustration of different caliber projectiles.

FIG. 2 illustrates a full-scale, full-mass projectile 30 on the left, a full-scale, half-mass projectile 40 in the middle and a sub-scale projectile 50 on the right.

Variables for a Projectile Cartridge and ETC Gun

There are a number of considerations in achieving optimum performance for a projectile cartridge for a hybrid variable velocity electric gun. These include the fuse wire material, the electrode material, the capillary liner material, proper launcher sealing, launcher hybridization (which includes the sealing, type of media, the mass of media, and means of restraint in the capillary), and the pulsed power supply characteristics. Some of these will now be discussed.

Figure 3:
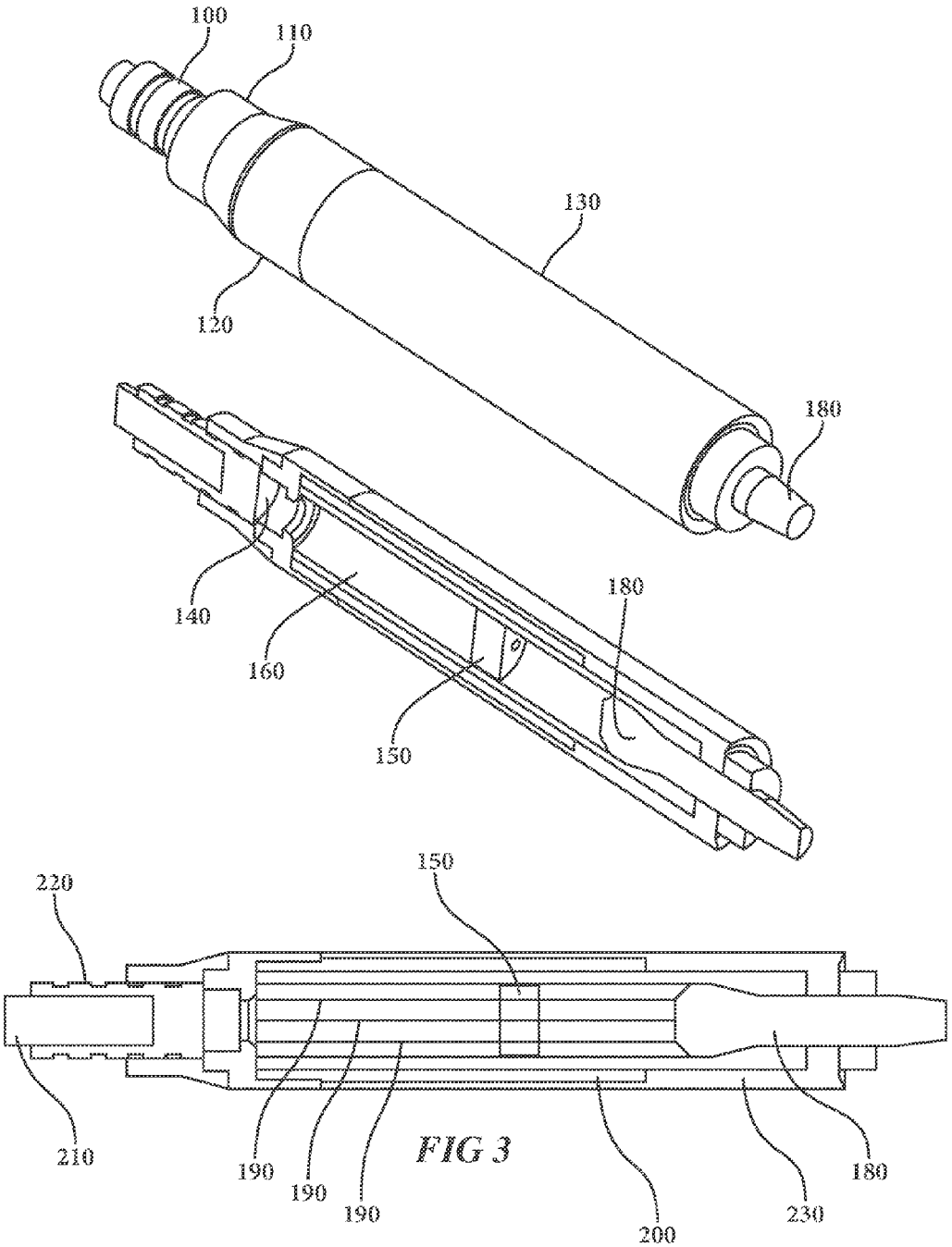
FIG. 3 is a representation of a complete projectile cartridge illustrating some of the embodiments of this disclosure.

FIG. 3 illustrates a complete projectile cartridge in three views as proposed by this disclosure. A completed projectile cartridge is shown in the top view. The projectile itself (slug and sabot) 100 is mounted in the cathode end 110 and is connected via a cathode/armor connection 120 to the main body of the projectile cartridge. The main body is enclosed in an overwrap 130. The anode end 180 projects from the back end of the projectile cartridge.

The middle view is a cross section exhibiting some of the interior elements. A diaphragm 140 (to be discussed) is located at the front end of a capillary liner 160 that extends through the cartridge. At the far end, the anode 180 sits within the capillary liner 160 and extends out of the cartridge. Within the capillary liner is a hybridization restraint 150, which may be a sponge, for containing the hybridization medium.

Further details are shown in the bottom cross-section view in which the projectile is shown as a slug 210 and a covering sabot 220. The capillary liner lies within a metal armor 200 that is surrounded by an overwrap 230. The armor may be a steel armor and it may be stainless steel. Connecting the cathode 110 and anode 180 are one or more fuse wires 190 that pass through hybridization medium 150. Each of these elements will be discussed in more detail.

Figure 4:
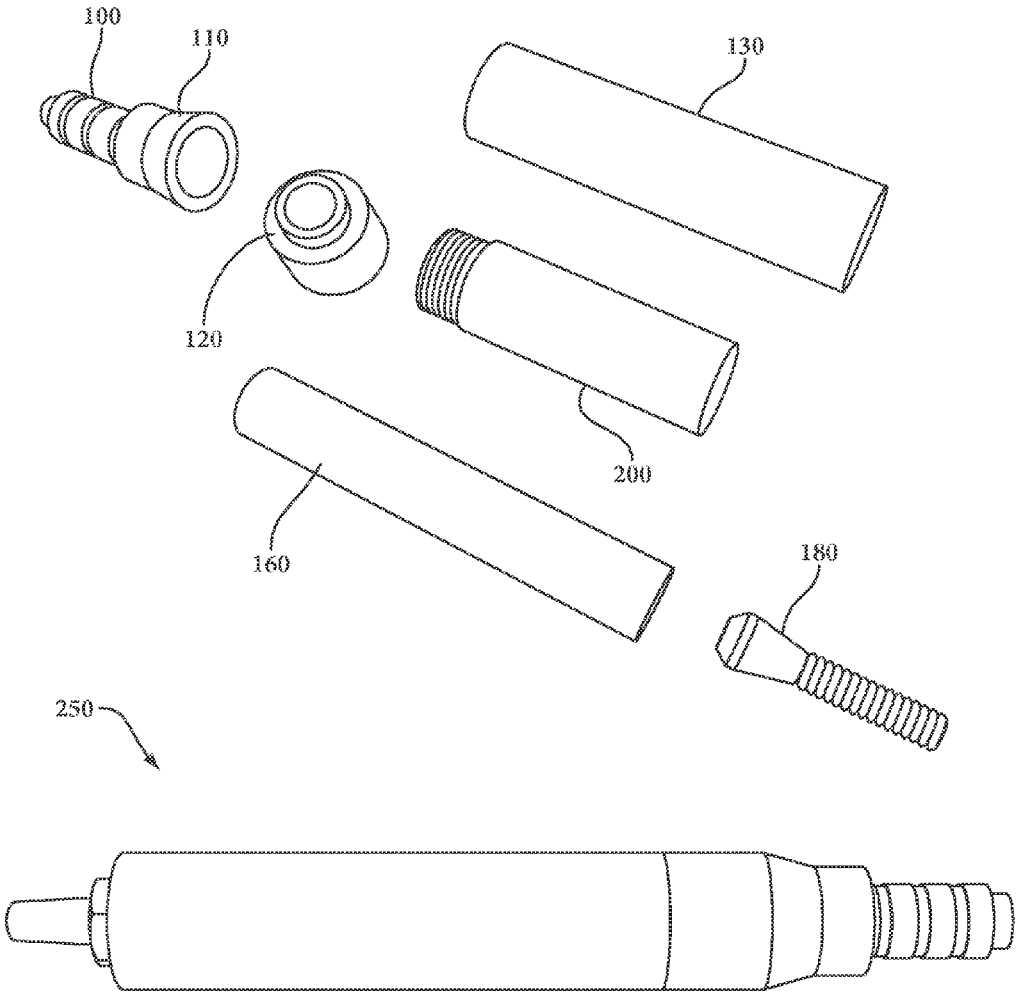
FIG. 4 is a an breakdown of the projectile cartridge of FIG. 3.

FIG. 4 is this same projectile cartridge 250 shown in a breakdown. The projectile 100 (slug plus sabot) is shown attached to a cathode 110. A cathode/armor connector 120 is shown next and is attached to the armor 200. In this example, it is a screw connection. The capillary liner is inserted into the armor 160 and an overwrap 130 surrounds the armor. The anode section 180 fits within the capillary liner of the cartridge. The thick Nylon 6/6 insulation schemes with heavy overwrap is used to insulate the vulnerable anode region for the higher voltages experienced during high velocity firings.

Launcher

Figure 5:
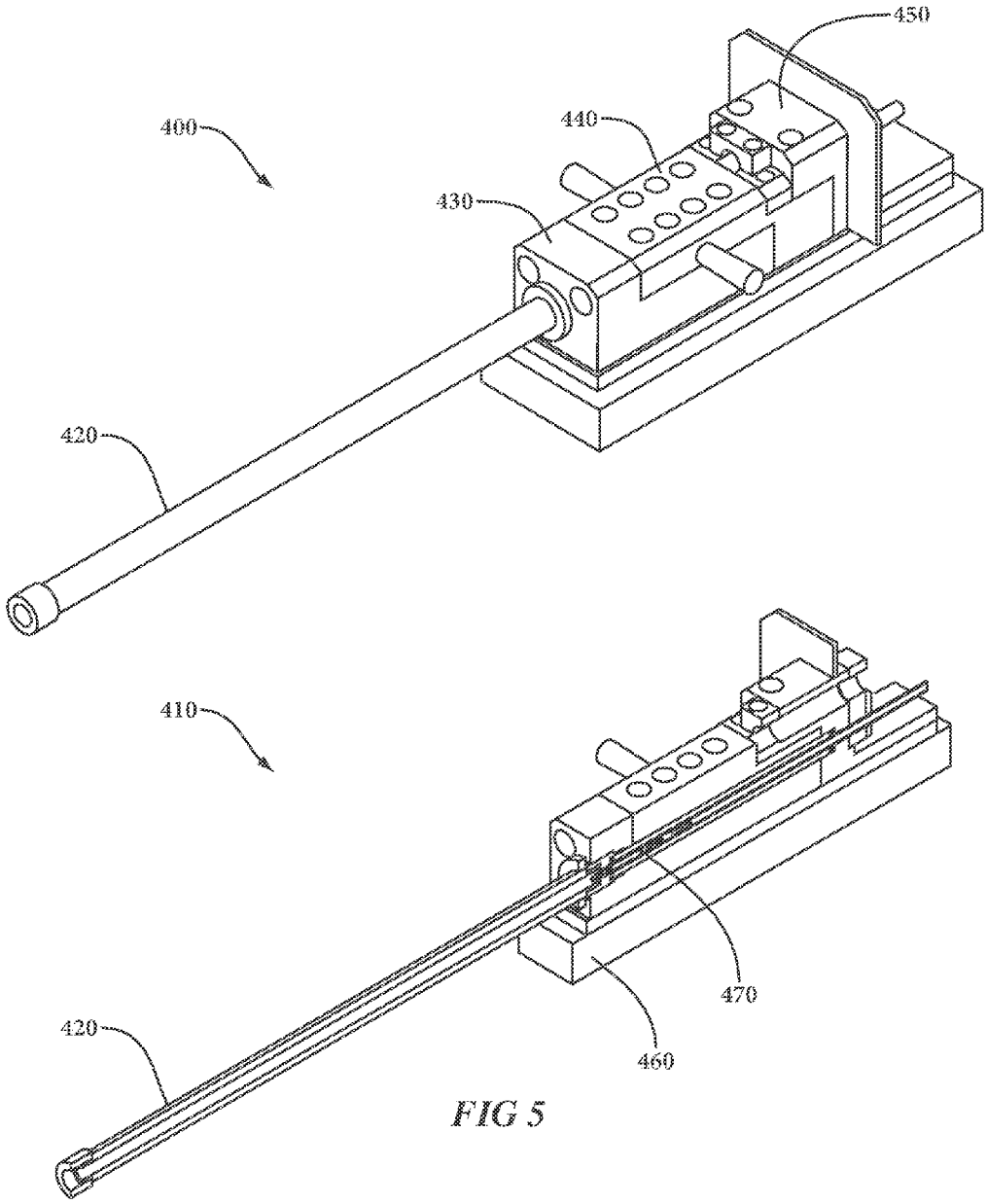
FIG. 5 is an illustrative view of a electric gun assembly, including a sectional view.

FIG. 5 illustrates a typical electric gun launcher assembly 400. It is broken up into three sub-assemblies: an anode/rear breech assembly 440, a forward breech assembly 430, and a barrel assembly 420. In cross section 410, the location of the projectile cartridge 470 is shown. The complete assembly is attached to an insulating mount 460. The rear of the assembly also includes connections 450 to a pulsed power supply to deliver electrical energy.

Figure 6:
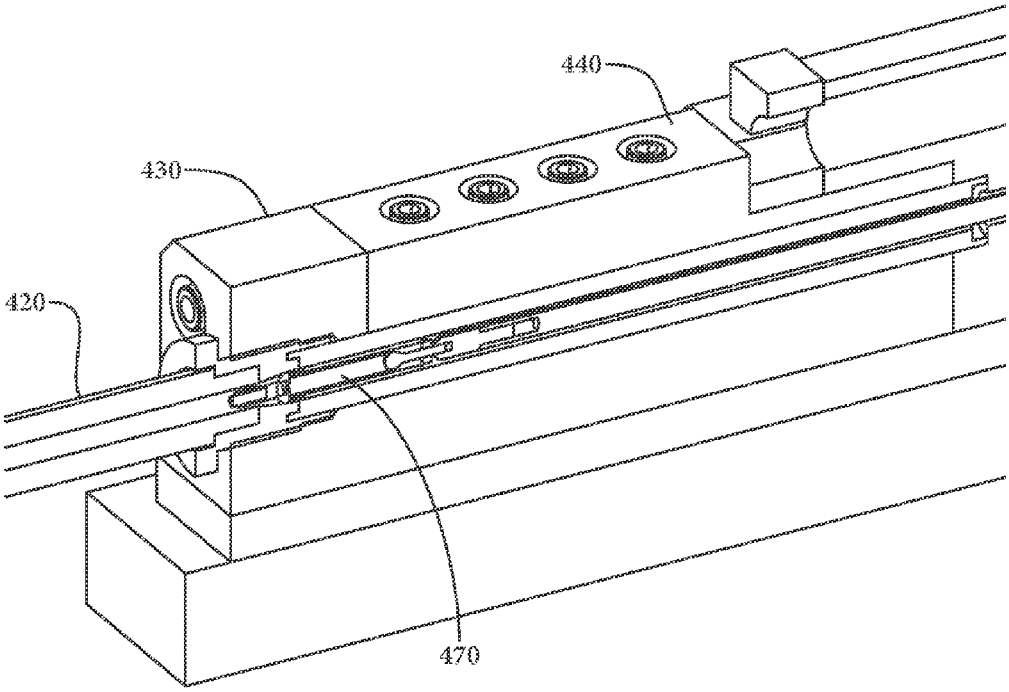
FIG. 6 is an expanded view of the sectional view of FIG. 5.

FIG. 6 is an expanded close-up of the electric gun launcher assembly showing again the barrel 420, forward breech half 430, and rear breech half 440 and showing in more detail the placement of the projectile cartridge 470 within the assembly.

Capillary Liner Material

Three different capillary materials were tested. A poly (methyl methacrylate) liner, a polycarbonate liner, and a high density polyethylene liner. It was found that the muzzle velocity was insensitive to liner material for both polycarbonate and polyethylene. The PMMA was attacked by methanol when methanol was used as the hybridization vehicle.

Hybridization Restraint

Hybridization refers to the use of substances other than air used to achieve higher muzzle velocities from the projectile cartridge. Most of the testing involved in this development was done with three substances—ethanol ($C_2H_5OH$), methanol ($CH_3OH$), and water ($H_2O$). Additionally, four different means were used to contain the hybridization media—encapsulation, rectangular strip sponges, cylindrical sponges, and direct injection of the substance into the capillary.

Many tests were conducted to examine the effects of hybridization. These included:

- Examination of the best fluid to use;
- Examination of the optimum hybridized fluid volume/masses;
- Examination of the best containment (restraint) method(s);
- Capillary optimization to transform the maximum amount of energy into projectile kinetic energy.

Restraint Methods

Figure 7:
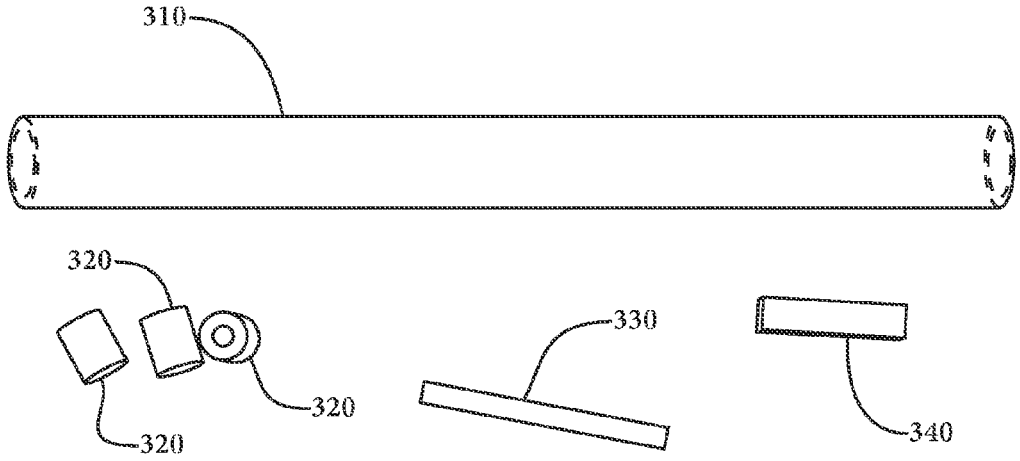
FIG. 7 is an illustration of several embodiments of hybridization restraints for the projectile cartridge.

FIG. 7 illustrates three different means to contain or restrain the hybridization media within the capillary liner 310 of the projectile cartridge. Cylindrical sponges 320 (surrounding the fuse wire(s)) are shown on the left, encapsulation 330 is shown in the middle, and a rectangular sponge 340 on the right. In addition, it was found that performance was improved when a diaphragm was placed over the end of the cathode in the projectile cartridge to ensure the hybridization fluid was not immediately ejected from the capillary. The diaphragm was shown as 140 in FIG. 3. In one embodiment, a Mylar diaphragm was found to be effective. The diaphragm could also act as a burst diaphragm. The capillary was tested in both open (no diaphragm) and closed configurations (with a diaphragm). It was found that there was a significant improvement in muzzle velocity when using the cylindrical sponges for the restraint in combination with a diaphragm.

Testing revealed that hybridization liquids greatly enhance the energy available for potentially accelerating the projectile. For identical setups, the direct injection method accelerated a projectile to a muzzle velocity of 1,004 m/s (a 63.7% increase over the non-hybridized case). The encapsulated test produced a muzzle velocity of 1,013 m/s (a 64.4% increase over the non-hybridized case). The sponge-hybridized case produced a muzzle velocity of 1,289 m/s (a 109% increase over the non-hybridized case). The reasons for this are hypothesized to be that for the direct injection case, the liquid is pooled at the bottom of the capillary. When the current is discharged, the shock sprays the liquid throughout the capillary, shielding the liner walls from the heat flux and minimizing the amount of material ablated (shown by the small amount of mass lost from the liner and the strikingly clean condition of the liner post-test). For the encapsulated methanol, energy must be expended in destroying the capsule to access the liquid methanol inside, which then again sprays all over the capillary, similarly to the direct injection case. The sponge holds the methanol in its pores and permits the remaining air inside the pores to be superheated during the reaction, permitting a great deal more of energy to be available to react with the methanol and produce a higher bore pressure. For these reasons, one preferred containment scheme is determined to be cylindrical sponges surrounding the fuse wire. It should be noted that if an excess of sponges are used to hold the hybridizing media, a similar effect is seen to the direct injection tests—the sponges will shield the liner walls (to some extent) from ablation that would normally take place during the capillary discharge.

Hybridization Fluid

Figure 8:
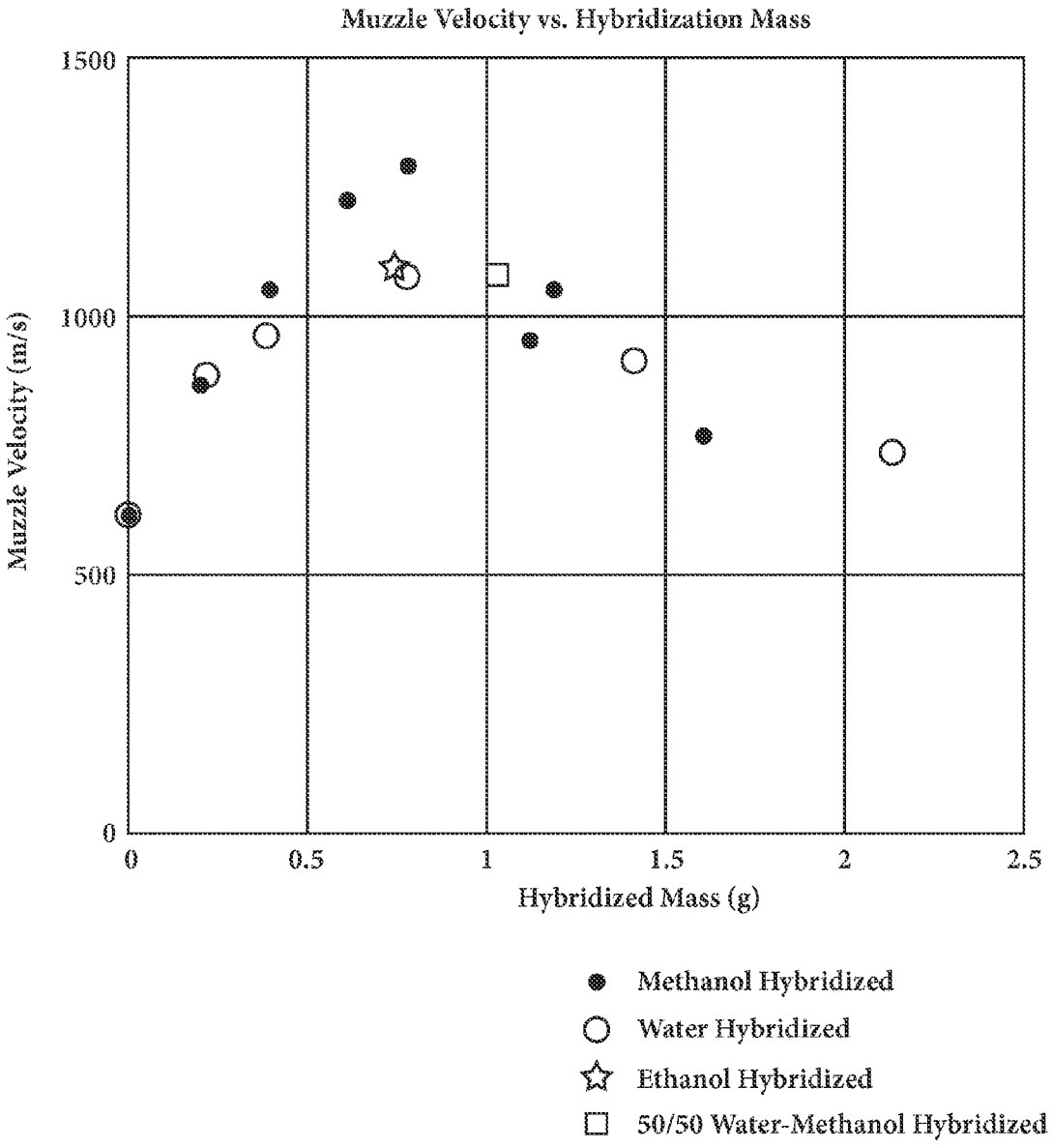
FIG. 8 is an illustration of some of the experimental results of muzzle velocity for different hybridization mediums.

Of the three hybridization fluids tested (methanol, ethanol, water), methanol was found to be the optimum liquid in terms of yielding the greatest muzzle velocity. The muzzle velocities vs. mass test results are shown in FIG. 8. FIG. 8 exhibits test results using methanol hybridization, ethanol hybridization, and water hybridization, as well as a 50/50 water-methanol hybridization mix (by volume). The highest muzzle velocities were obtained for methanol hybridization. It should also be noted that there is a "peak" velocity which is a function of the hybridization mass.

Fuse Wire Material

Various materials were investigated for the fuse wire material. Al, Cu, Zn, Co, and Ni were tested. Each was tested at constant input electrical energies to determine the effect on the muzzle velocity. Although some very modest differences were noted, it was determined that there was not a significant difference between using any wire material over the others.

Electrode Materials

Again, a number of electrode materials were tested. These included AISI 304S, UNS C182, Molybdenum, Graphite, and 10W3 Elkonite at constant input electrical energy. Although some differences were noted it was found that muzzle velocity is relatively insensitive to electrode material.

Capillary Liner Material

Three different capillary materials were tested. A poly (methyl-methacrylate) liner, a polycarbonate liner, and a high density polyethylene liner. It was found that the muzzle velocity was insensitive to liner material for both polycarbonate and polyethylene. The poly(methyl-methacrylate) was attacked by methanol when methanol was used as the hybridization vehicle.

Figure 9:
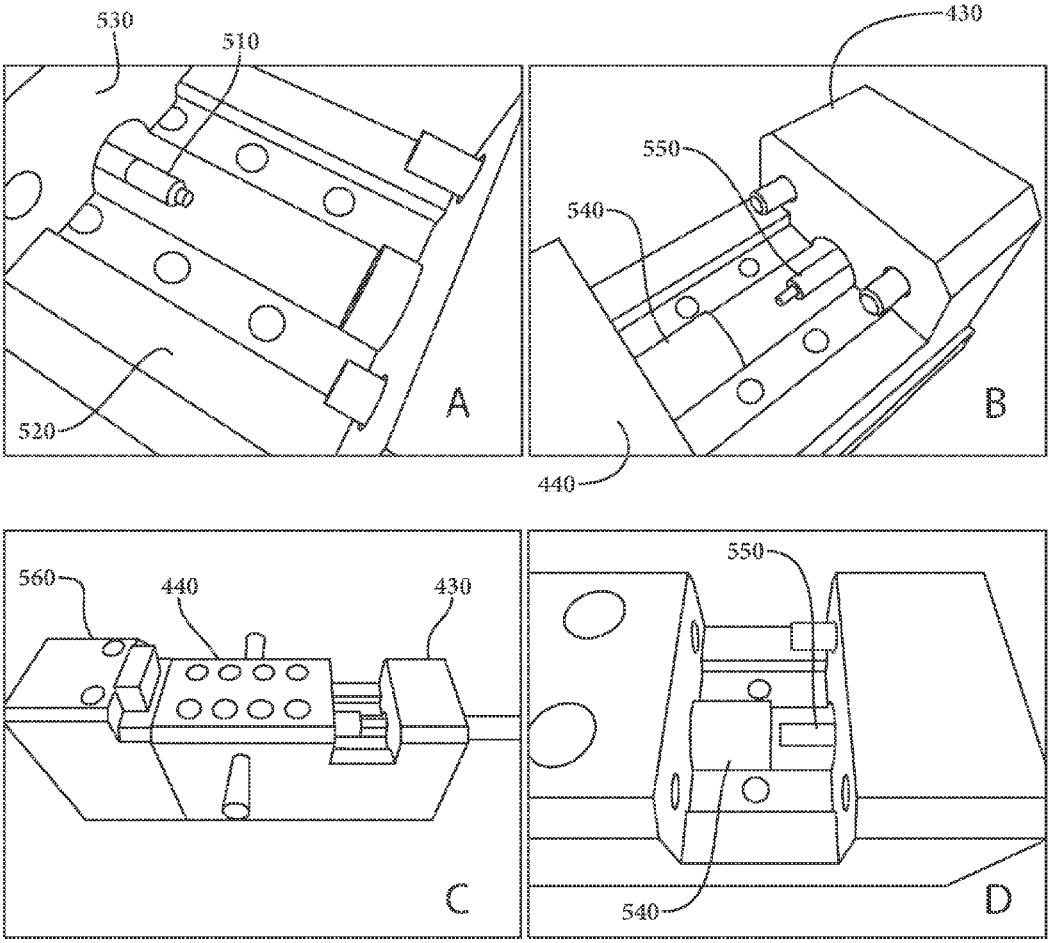
FIGS. 9 A, B, C, and D in four views illustrates the process of loading the proposed projectile cartridge into an electric gun assembly.

Finally—FIG. 9 demonstrates a typical operation of the use of a projectile cartridge in a hybrid electric launcher. FIG. 9C is a full view of the launcher breech, showing the breech rear half 440 and the forward breech half 430. The pulsed power supply connections 560 are shown behind the breech rear half. In FIG. 9A the breech is opened, exposing the forward breech half 520. The anode connection to the cartridge 510 extends from the primary insulator. In FIG. 9B the projectile cartridge 550 is seated into the forward breech half. The primary insulator 540 containing the anode connection to the cartridge is then shown. Final loading is achieved by sliding the rear breech half 440 forward (FIG. 9D) to connect the anode connection to the cartridge.

Although certain embodiments and their advantages have been described herein in detail, it should be understood that various changes, substitutions and alterations could be made without departing from the coverage as defined by the appended claims. Moreover, the potential applications of the disclosed techniques is not intended to be limited to the particular embodiments of the processes, machines, manufactures, means, methods and steps described herein. As a person of ordinary skill in the art will readily appreciate from this disclosure, other processes, machines, manufactures, means, methods, or steps, presently existing or later to be developed that perform substantially the same function or achieve substantially the same result as the corresponding embodiments described herein may be utilized. Accordingly, the appended claims are intended to include within their scope such processes, machines, manufactures, means, methods or steps.

What is claimed is:

1. A projectile cartridge for a hybrid variable velocity electric gun comprising:

a. a capillary liner;

b. separated anode and cathode electrodes deployed within the capillary liner;

c. one or more fuse wires deployed through the capillary liner connecting the two electrodes;

d. a hybridization medium within the capillary liner for achieving higher muzzle velocities;

e. a metal armor surrounding the capillary liner; and f. a plastic overwrap encapsulating the metal armor.

2. The projectile cartridge of claim 1 wherein the hybridization medium is restrained within the capillary liner.

3. The projectile cartridge of claim 2 wherein the hybridization medium is restrained by sponges surrounding the one or more fuse wires.

4. The projectile cartridge of claim 3 wherein the sponges surrounding the one or more fuse wires are cylindrical.

5. The projectile cartridge of claim 2 wherein the hybridization medium is restrained by encapsulation.

6. The projectile cartridge assembly of claim 2 wherein the hybridization medium is restrained by rectangular sponges.

7. The projectile cartridge of claim 1 wherein the hybridization medium comprises methanol.

8. The projectile cartridge of claim 1 wherein the hybridization medium comprises ethanol.

9. The projectile cartridge of claim 1 wherein the hybridization medium comprises water.

10. The projectile cartridge of claim 1 wherein the capillary liner comprises polycarbonate.

11. The projectile cartridge of claim 1 wherein the capillary liner comprises high density polyethylene.

12. The projectile cartridge of claim 1 wherein the projectile cartridge further comprises a projectile.

13. The projectile cartridge of claim 12 wherein the projectile comprises a slug and a sabot jacket.

14. The projectile cartridge of claim 13 wherein the projectile slug comprises an aluminum alloy.

15. The projectile cartridge of claim 13 wherein the projectile slug comprises steel.

16. The projectile cartridge of claim 13 wherein the projectile slug comprises Macor ceramic.

17. The projectile cartridge of claim 13 wherein the projectile sabot jacket is made of Nylon 6/6.

18. The projectile cartridge of claim 1 wherein a burst diaphragm is installed over the cathode end of the cartridge.

19. The projectile cartridge of claim 18 wherein the burst diaphragm comprises Mylar.

20. The projectile cartridge of claim 1 wherein the metal armor comprises stainless steel.

* * * * *